United States Patent [19]

Hernandez

[11] 4,110,846

[45] Sep. 5, 1978

[54] COMBINED SCARF AND HOOD

[76] Inventor: Robert Hernandez, 120 Andrews Ct., Turlock, Calif. 95380

[21] Appl. No.: 799,115

[22] Filed: May 20, 1977

[51] Int. Cl.[2] ..... A42B 1/04

[52] U.S. Cl. ..... 2/203

[58] Field of Search ..... 2/209, 203, 91, 193, 2/209.1, 186, 207

[56] References Cited

U.S. PATENT DOCUMENTS

| | | | |
|---|---|---|---|
| 2,735,283 | 2/1956 | Schuessler | 2/203 |
| 2,806,222 | 9/1957 | Carpenter | 2/91 |
| 3,238,536 | 3/1966 | Gettinger | 2/207 |
| 3,541,610 | 11/1970 | Gettinger | 2/203 |

*Primary Examiner*—Doris L. Troutman
*Attorney, Agent, or Firm*—Lothrop & West

[57] ABSTRACT

A combined scarf and hood is made of a sheet of cotton terry cloth of approximately triangular shape affording three apices. One of the apices is truncated to leave a margin of a predetermined length, to which is stitched the corresponding major margin of combined hood panels. The other, major margin of the combined hood panels is shorter than the stitched margin to provide a pocket. One of the other apices has a tape secured to it, and the tape has one or more fasteners, such as Velcro, arranged to engage with a complimentary fastener secured to the remaining one of the apices. The sheet preferably is of a size adapting the combined scarf and hood to be worn by an adult with the truncated apex at the back of the neck, with other portions of the sheet crossed over the chest, with the remaining two apices at the sides and beneath the shoulders, and with the tape around the body and the fasteners secured.

3 Claims, 5 Drawing Figures

COMBINED SCARF AND HOOD

BRIEF SUMMARY OF THE INVENTION

Individuals, particularly adults engaging in athletic enterprises and the like, customarily wear or utilize a short towel or cloth around the neck from time to time in order to absorb perspiration and when removed useful in drying off other areas of the body. Sometimes the towel is worn or wrapped around the neck as a scarf for protection from the wind and the like. A difficulty is that during strenuous movement the towel often becomes dislodged or is not readily available or, worse, interfers with the free motion of the user's arms and body.

To overcome these and other drawbacks and to provide an improved article for comparable use, there is provided a sheet of material, preferably cotton terry cloth, since it is quite water absorbent. The sheet is formed in plan of an approximately triangular shape, the shape of a relatively flattened triangle having three apices, one of which is truncated to provide an edge portion or margin of a predetermined length. Secured to that margin is a pair of hood panels. These are two sheets of comparable material sewn together centrally and on one margin being of substantially the same length as the truncated portion of the main sheet margin. These margins of similar length are stitched together. The remaining margin of the combined hood panels is made somewhat shorter than the predetermined length, so that there is a gathering or shortening of the edge of the material to provide a pocket. One of the other apices is provided with an elongated tape secured at one end in position and at the other or near the other end carrying one or more fastener elements usually utilized in pairs. For example, a two-element Velcro fastener can be readily utilized. The remaining apex receives and carries the cooperating element of the fastener.

The article is utilized usually, although not necessarily, by an adult by putting the truncated apex at the back of the neck, crossing other portions of the sheet across the chest, and leaving the remaining apices at the sides generally beneath the shoulders. The tape is continued around the body, and the fasteners are engaged. With this arrangement, there is always available an absorbent cloth around the neck, an article for use as a towel, and the hood can be raised and fitted over the user's head if desired and to afford adequate protection, yet there is no interference with the athletic use of the wearer's body.

DETAILED DESCRIPTION

Figure 1:
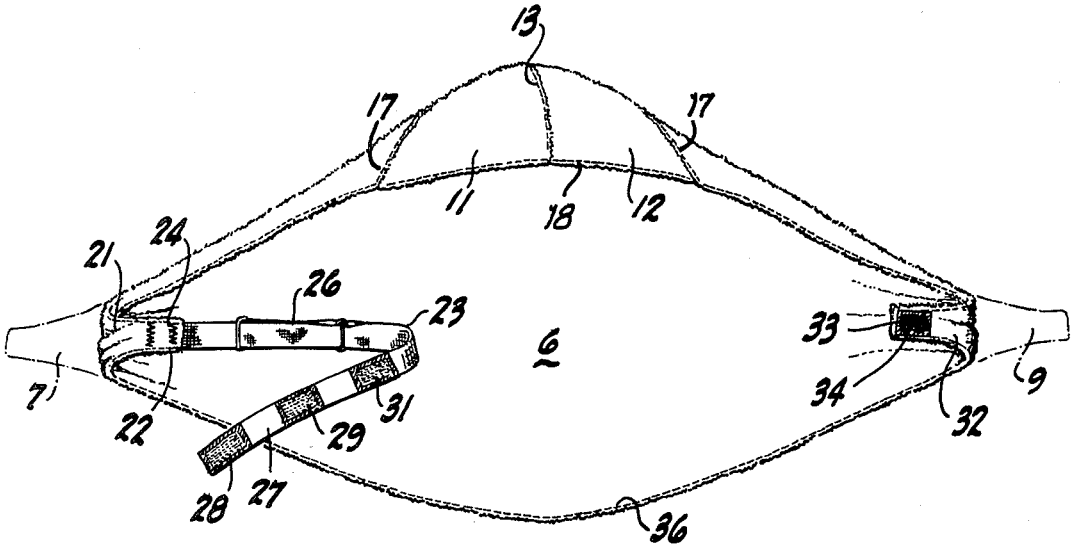
FIG. 1 is a plan of the combined scarf and hood of the invention, certain portions being turned out of the general plane of the view for clarity.
Figure 3:
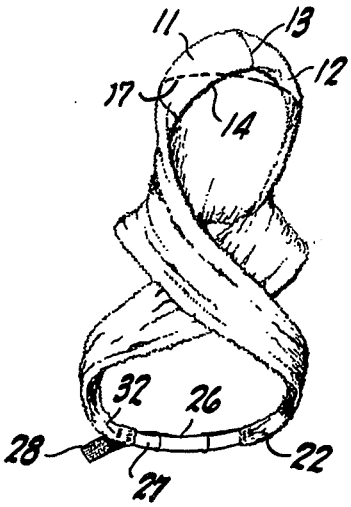
FIG. 3 is a view comparable to FIG. 2 but showing the article with the hood up.
Figure 4:
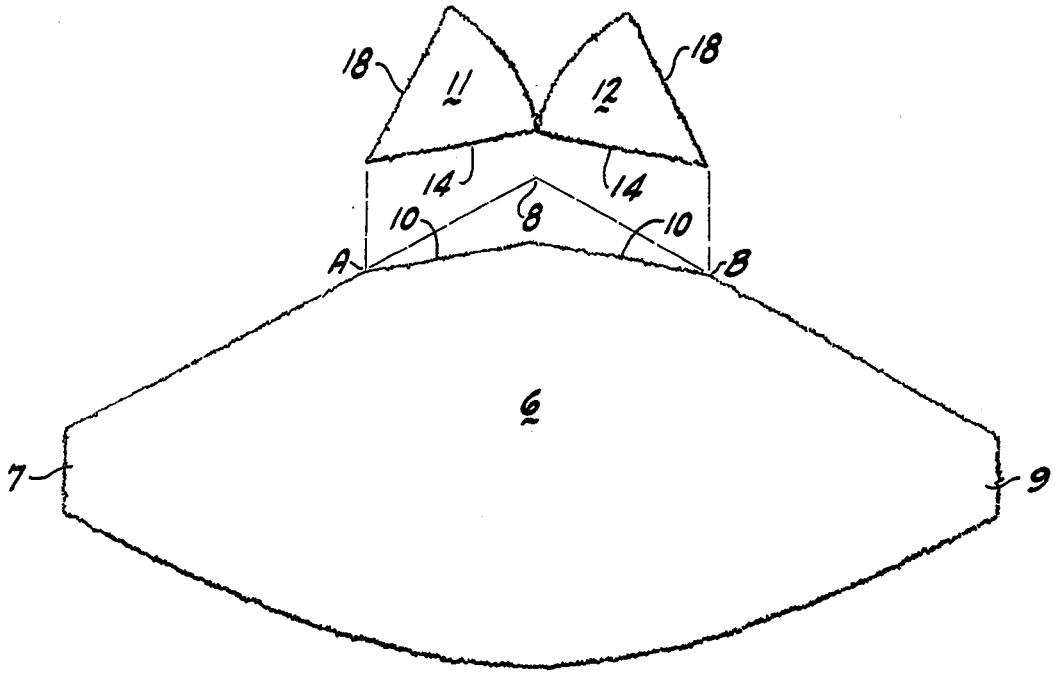
FIG. 4 is a plan of the three pieces of cloth prior to assembly of the combined hood and scarf of the invention.
Figure 5:
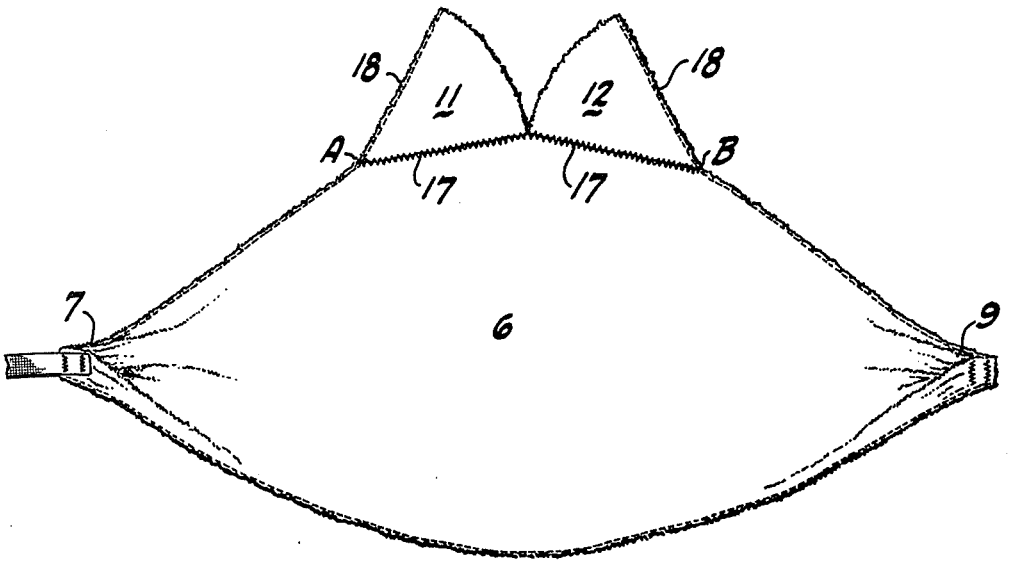
FIG. 5 is a plan of the three pieces of cloth partially assembled into the combined hood and scarf of the invention.

In carrying out one embodiment of the invention, there is preferably provided a sheet 6 of water absorbent material; for example, of cotton terry cloth. The sheet is originally cut or shaped to have an approximately triangular, an obtuse triangular, configuration affording three apices 7, 8 and 9, as shown in FIG. 4. Adjacent the apex 8 the material is cut or truncated along a margin 10 separating the apex 8 and defining a predetermined edge length between the truncation end points A and B. Additional pieces of comparable material are utilized as hood panels 11 and 12 and are preferably secured together by a central seam of stitching 13 (see FIGS. 1 and 3). The panels 11 and 12 when secured together have a major margin 14 of approximately the same length as the margin 10, to which the hood panels are secured by a line 17 of stitching (see FIG. 5). The remaining major margin 18 of the sewn-together pair of hood panels is made somewhat shorter than the length of the flat sheet 6 along the margin 10 between the points A and B, so that the hood when unfolded assumes and maintains a substantial pocket configuration.

One of the other apices; for example, the apex 7, is folded over and somewhat shaped by gathering 21 to provide a point of attachment for one end 22 of a strap 23. The strap may be of elastic material or of non-expansible material, according to preference, and its end 22 is secured in position on the apex 7 of the sheet 6 by multiple stitching 24. The strap 23 may have a length adjusting device 26 therein, but this is often dispensed with if the strap is itself elastic or has multiple fasteners. On the strap, particularly at the other end 27 thereof, is fastened one portion 28 of a two-part fastening device such as a Velcro fastener. In addition to the one Velcro fastening portion 28, there may also be provided additional, similar fastening portions 29 and 31, preferably spaced apart along the length of the strap.

The third apex 9 is provided also with folds or gathers 32 to afford a base for the attachment of a fastening unit 33 secured in position by stitching 34 or the like. The fastening device 33 readily interengages with and disengages from any one of the portions 28, 29 and 31.

It is convenient to provide a hem 36 around all or most of the exposed edge or margin of the article but, depending upon the nature of the material utilized, the hem can sometimes be dispensed with.

Figure 2:
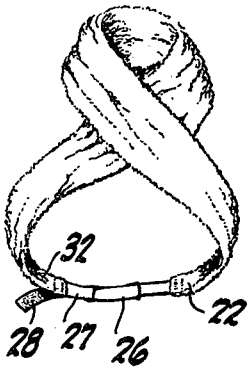
FIG. 2 is an isometric perspective view of the combined scarf and hood as it appears in a position of use with the hood down.

In the use of the article, the truncated apex 8 is positioned near the back of the user's neck with the article disposed symmetrically on his body, being passed over the shoulders and then being crossed in front across the chest, with the apices 7 and 9 being disposed at the sides and substantially beneath the shoulders. The strap 23 is brought around the back of the body, and one or the other of the fastening elements 28, 29 and 31 is secured to the fastening element 33, depending upon the user's size and the tightness desired, to complete the donning of the article. This is the condition disclosed in FIG. 2 and serves generally to substitute for the ordinarily used towel.

In some instances it is desired to wear the hood also. In this instance, as shown in FIG. 3, the two hood panels 11 and 12 are erected over and on the user's head. In addition to the absorbing quality, there is afforded a protection against wind or other exposure. At any time when the device is to be utilized generally as a towel, it is easy to disengage the fastener 33 and to remove the device at least in part and to utilize it as a normal towel. The article is easily doffed and donned and is readily laundered. Being entirely flexible, it can be folded or reduced into a very small compass or folded into the hood and carried in a pocket or the like. Although the article is primarily designed for use by adult athletes, it can be made in various different sizes and proportions, in any dimensions and configurations especially adapted for individual users.

I claim:

1. A combined scarf and hood comprising a sheet of cloth originally of approximately triangular shape in plan providing three apices but truncated to sever one apex and provide a margin, a pair of hood panels of cloth, means for securing said hood panels to adjoin each other along a central seam, means for securing said adjoined hood panels to said sheet along said margin with said hood panels and said sheet forming a pocket for the user's head, a securing strap, means for securing one end of said strap to the second of said apices, a two-part fastening device, means for securing one part of said fastening device to the other end of said strap, and means for securing the other part of said fastening device to the third one of said apices.

2. A device as in claim 1 in which said margin has a predetermined length and in which said pair of hood panels has one combined margin substantially of said predetermined length and a remaining combined margin of substantially less than said predetermined length.

3. A device as in claim 1 in which said sheet is of a size to be worn by an adult with said margin adjacent the back of the neck, other portions of said sheet crossed over each other on the chest and with the remaining ones of said apices at the opposite sides beneath the shoulders.

* * * * *